US010174663B1

(12) United States Patent
Pehrsson

(10) Patent No.: US 10,174,663 B1
(45) Date of Patent: Jan. 8, 2019

(54) DOUBLE LAYERED, BENT EXHAUST PIPE

(71) Applicant: Dynaflex Products, Commerce, CA (US)

(72) Inventor: Cory Pehrsson, Commerce, CA (US)

(73) Assignee: Dynaflex Products, Commerce, CA (US)

( * ) Notice: Subject to any disclaimer, the term of this patent is extended or adjusted under 35 U.S.C. 154(b) by 0 days.

(21) Appl. No.: 15/848,425

(22) Filed: Dec. 20, 2017

(51) Int. Cl.
*F01N 13/08* (2010.01)

(52) U.S. Cl.
CPC ..... *F01N 13/08* (2013.01); *F01N 2470/20* (2013.01); *F01N 2470/30* (2013.01); *F01N 2510/00* (2013.01)

(58) Field of Classification Search
CPC ..... F01N 13/14; F01N 13/141; F01N 1/166; F01N 1/08; F01N 13/185; F01N 2240/20; F01N 13/08; F01N 2510/00; F01N 2470/30; F01N 2470/20
See application file for complete search history.

(56) References Cited

U.S. PATENT DOCUMENTS

2011/0047998 A1* 3/2011 Adachi ..... F01N 13/008 60/324

OTHER PUBLICATIONS

Vance & Hines—Twin Slash Staggered, Kawasaki, archived webpage.

* cited by examiner

*Primary Examiner* — Brandon Lee
(74) *Attorney, Agent, or Firm* — Fish IP Law, LLP

(57) ABSTRACT

An exhaust pathway for an internal combustion engine passes from a larger pipe to a smaller pipe, and then back to a larger pipe. The smaller pipe has a bend of at least approximately 80°, and each of the smaller and downstream larger pipes is disposed within, and spaced apart from, portions of a shell, such that cooling air passes in an air gap between the pipes and the shell.

7 Claims, 3 Drawing Sheets

DOUBLE LAYERED, BENT EXHAUST PIPE

FIELD OF THE INVENTION

The field of the invention is exhaust pipes for large trucks having internal combustion engines.

BACKGROUND

Exhaust from internal combustion engines, whether diesel or gasoline, is typically at least 500° F. Exhaust from a thermal converter is even hotter, at least 1200° F. Were such hot gasses to pass through a chrome plated exhaust pipe, the chrome would quickly become discolored.

One solution is to space a chrome-plated shell about the exhaust pipe, thereby providing a cooling air gap between the shell and the pipe. For example, a 2016 journal article depicts a shell disposed about an exhaust pipe, with ambient air flowing through an air gap between the shell and the pipe. Xiaohu Dong, Huiqing Liu and Zhangxin Chen, Mathematical Modeling of Heat Transfer and Pressure Drops in the Single- and Dual-Pipe Horizontal Wells, J. Thermal Sci. Eng. Appl 9(1), 011016 (Nov. 16, 2016). In another example, a company named Vance & Hines produces an exhaust system having ambient air flowing through an air gap between the shell and the pipe. See https://products-.vanceandhines.com/store/kawasaki/18397/.

All publications herein are incorporated by reference to the same extent as if each individual publication or patent application were specifically and individually indicated to be incorporated by reference. Where a definition or use of a term in an incorporated reference is inconsistent or contrary to the definition of that term provided herein, the definition of that term provided herein applies and the definition of that term in the reference does not apply.

While the Vance & Hines system might be motorcycles, where the exhaust pipes are relatively small, and the bends are substantially less than 90° adequate, that system would not work well for large trucks, where exhaust pipes can be 5" or more, and the pipe needs to be curved by about 90°.

Thus, there is still a need for apparatus, systems and methods accommodating bends in exhaust pipes from large internal combustion engines.

SUMMARY OF THE INVENTION

The inventive subject matter provides apparatus, systems and methods in which an exhaust pathway for an internal combustion engine passes from a larger pipe to a smaller pipe, and then back to a larger pipe. The smaller pipe has a bend of at least approximately 80°, and each of the smaller and downstream larger pipes is disposed within, and spaced apart from, portions of a shell, such that cooling air passes in an air gap between the pipes and the shell.

To facilitate the flow of the cooling air, a first baffle conducts atmospheric air into the first air gap, a second baffle conducts air between the first air gap and the second air gap, and a third baffle conducts air from the second air gap back into the atmosphere.

When implemented in a truck, exhaust will commonly exit the catalytic converter substantially in a horizontal orientation, and the exhaust stack will typically be oriented vertically. In such instances, each of the intermediate exhaust segment and the first shell are curved by about 90°, and more preferably between 85° and 95° Also, since the exhaust stack on a truck will likely be at least 3 meters long, the shell is also at least 3 meters long.

In especially preferred embodiments, the upstream exhaust segment has a maximal inside diameter of at least 5", the intermediate exhaust segment has a maximal inside diameter of no more than 4", and the upstream segment has a maximal inside diameter of at least 4.75".

Also in preferred embodiments, the intermediate and downstream exhaust segments comprise a stainless steel, and the shell has a chrome or powder coating.

Various objects, features, aspects and advantages of the inventive subject matter will become more apparent from the following detailed description of preferred embodiments, along with the accompanying drawing figures in which like numerals represent like components.

DETAILED DESCRIPTION

Figure 1:
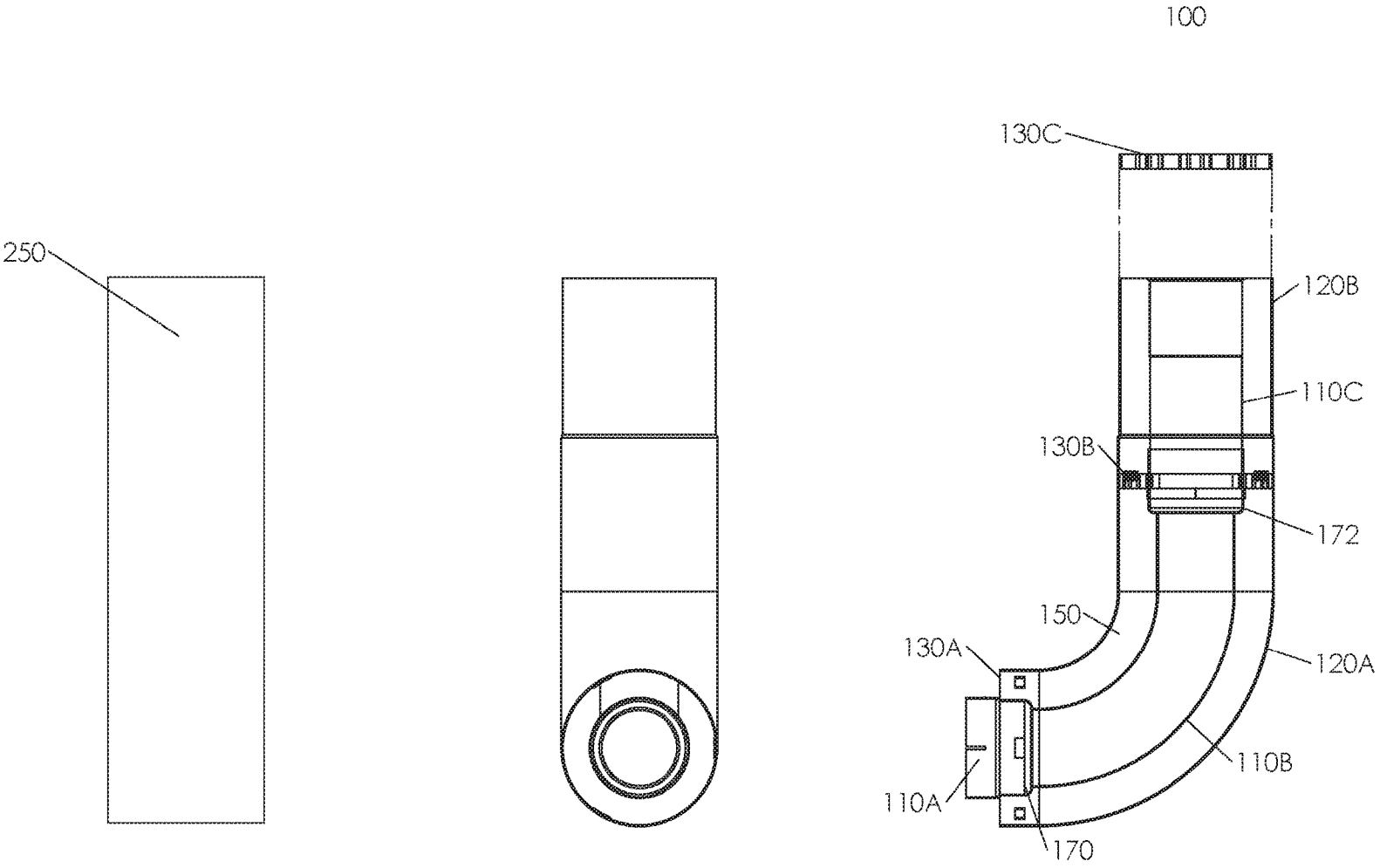
FIG. 1 is a vertical cross-section of a double-layered bent exhaust pipe.

FIG. 1 generally depicts an exhaust system 100 that includes upstream, intermediate and downstream exhaust pipe segments 110A, 110B, and 110C, respectively. The upstream exhaust segment 110A receives exhaust gas from an internal combustion engine (not shown), with a catalytic converter (not shown) and/or muffler (not shown) fluidly disposed between the engine and the upstream exhaust segment 110A. The downstream exhaust segment 110C releases exhaust gas to the atmosphere.

A first segment 120A of the shell 120 is disposed about the intermediate exhaust segment 110B, and second segment 120B of the shell is disposed about the downstream exhaust segment 110C. This arrangement provides a continuous air gap 150 between the intermediate and downstream exhaust segments 110B, 110C and the shell 120. Air enters the air gap 150 through a baffle 130A disposed within the lumen of the first segment 120A of the shell, passes though baffle 130B disposed within the lumen of the lower end of the second segment 120B of the shell, and then out to the atmosphere through baffle 130C, disposed within the lumen of the upper end of second segment 120B of the shell.

When installed in a typical semi truck 300, the upstream exhaust segment often has an inside diameter of at least 5". This is problematic because if the intermediate exhaust segment 110B were to have the same 5" inside diameter, the bent region of the pipe and its shell are so large that they are very difficult to bend without producing significant distortions.

The class of solutions contemplated herein provides an intermediate exhaust segment 110B having a smaller inside diameter than both upstream and downstream exhaust segments, 110A, 110C. A reducer 170 is used to couple the upstream and intermediate exhaust segments 110A, 110B, and an expander 172 is used to couple the intermediate and downstream exhaust segments 110B, 110C.

In a particularly preferred embodiment the upstream, intermediate and downstream exhaust segments 110A, 110B and 110C have inside diameters of 5", 4" and 4.75", respectively, and the upstream and second shells 120A, 120B have substantially the same outer diameters of 7.845".

More generally, it is preferred that a maximal normal cross-section area of the intermediate exhaust segment 110B is at least 10% smaller than that of the upstream exhaust segment 110A. It is even more preferred that a maximal normal cross-section area of the intermediate exhaust segment 110B is smaller by at least 15% than that of the upstream exhaust segment 110A, and still more preferred smaller by at least 20%.

It is also preferred that the maximal normal cross-section of area of the downstream exhaust segment 110C has at least 10% larger than that of the intermediate exhaust segment 110B. It is even more preferred that a maximal normal cross-section area of the downstream exhaust segment 110C is larger by at least 15% than that of the intermediate exhaust segment 110B, and still more preferred larger by at least 20%.

FIG. 1 should be interpreted as showing intermediate exhaust segment 110B bent to between 80° and 100°, with the center bent at a radius of about 8". Preferred bends are between 85° and 95°, more preferred bends are between 88° and 92°, and a most preferred bend is approximately 90°.

Figure 3:
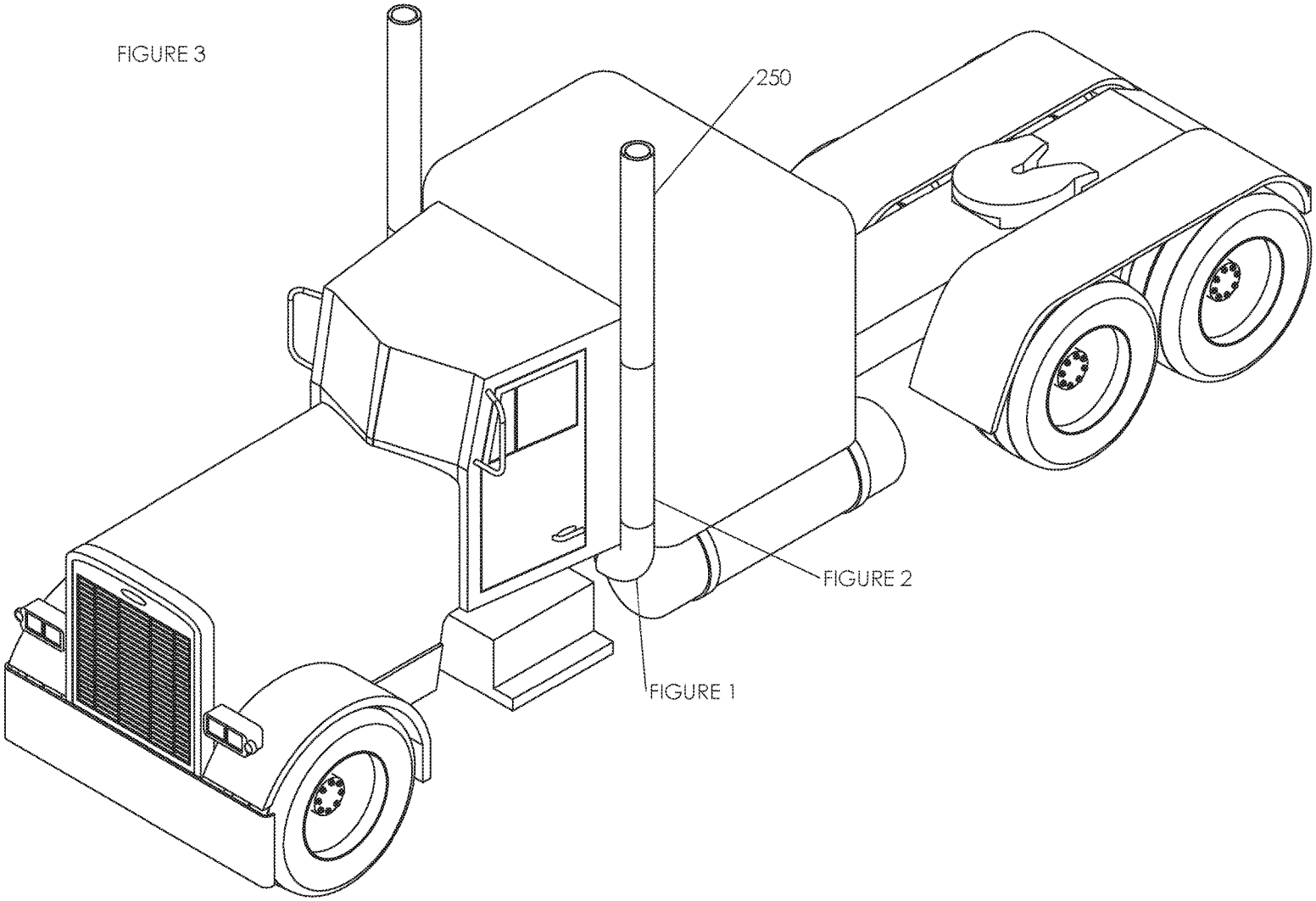
FIG. 3 is a picture of a semi-track mounted the double-layered bent exhaust pipe.

The various exhaust segments 110A, 110B and 110C can be of any suitable lengths, which would depend on the size of the truck to which they are installed, and in some cases on person preference. In FIG. 3 intermediate exhaust segment 110B is about 14" long, and the second shell 110C is at least 10 feet long.

Each of upstream, intermediate and downstream exhaust segments 110A, 110B and 110C, and shell segments 120A and 120B are made of a stainless steel to avoid corrosion, preferably 304 or 409 steels. Shell segments 120A and 120B are to be interpreted as being either powder coated or layered with chrome. The inside diameters of shell segments 120A and 120B are preferably selected relative to the outside diameters of intermediate and downstream exhaust segments 110B, 110C such that there is sufficient airflow through air gap 150 to keep the shell segments 120A, 120B below temperatures that would disrupt the integrity of the coating.

Since exhaust gas within the upstream exhaust segment 110A could be at least 450° F., the size of the air gap is particularly important in the case of chrome coatings. If the chrome becomes too hot, chemical interaction with bugs that hit the chrome can cause significant erosion of the chrome. It is preferred that the air gap 150 be at least 1 in.

Figure 2B:
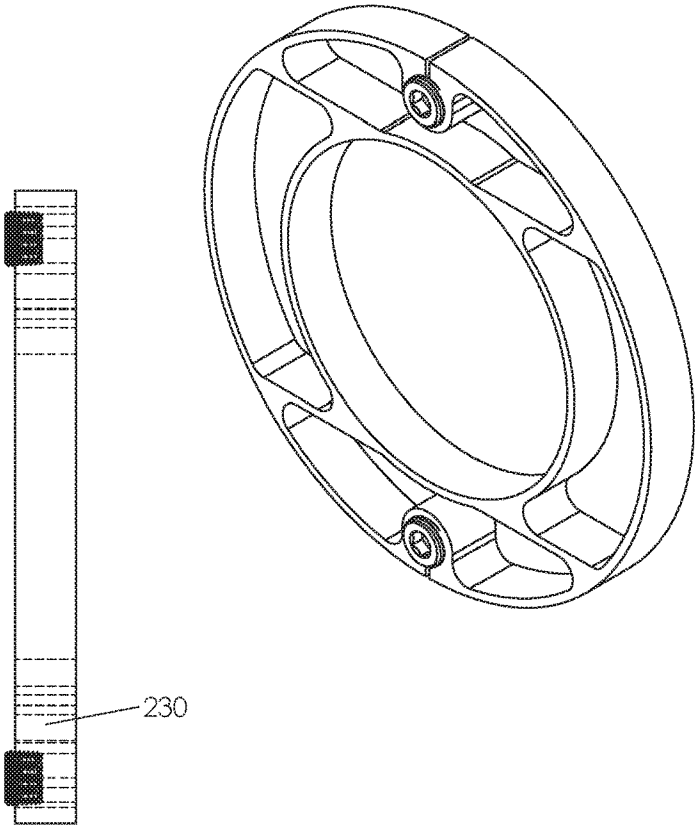
FIG. 2B is a perspective view of the baffle of FIG. 2A.
Figure 2A:
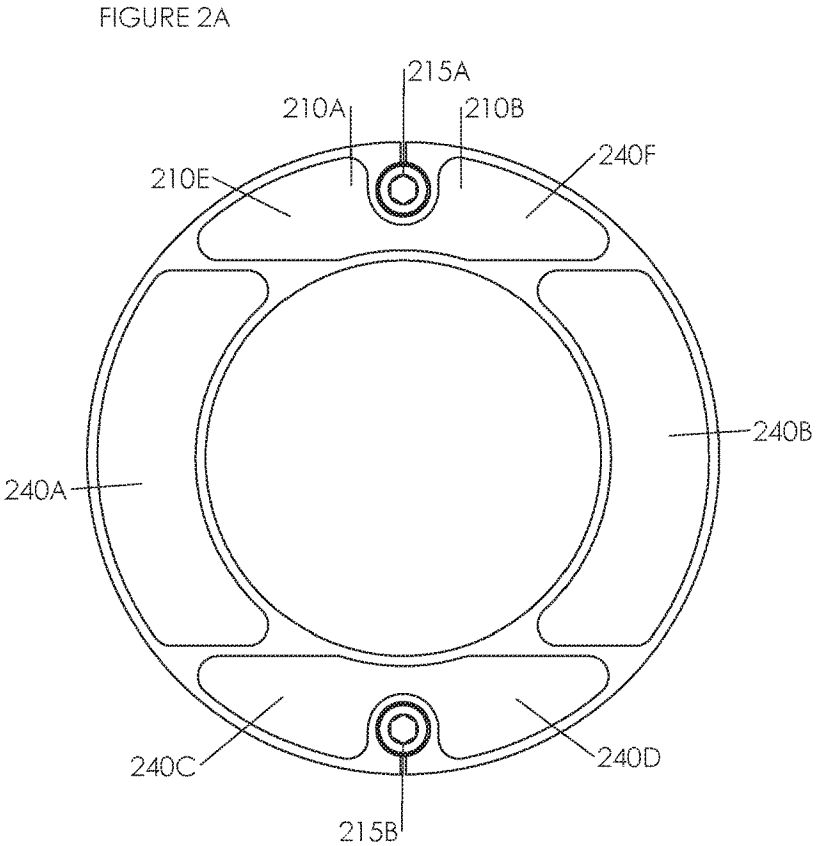
FIG. 2A is a plan view of a preferred baffle.

FIGS. 2A and 2B generally depicts baffle 220, which can correspond to any one or more of baffles 130A, 130B and 130C. Baffle 200 includes first and second mirror image halves 210A, 210B, coupled at pivot 220, and brought together at opposite end 230. The two halves 210A, 210B can be held together by screws or hex-socket plugs 215A, 215B.

Baffle 200 has air passageways 240A, 240B, 240C, 240D, 240E and 240F. There can be more or fewer gaps in different embodiments, and they can have any suitable shapes. The passageways are meant to be a large as realistically possible to provide minimal resistance to flow of air, given the need to maintain structural integrity. Baffles 200 can be manufactured in any suitable manner, including for example water cast aluminum.

In FIG. 1 baffle 130A is shown as being disposed about the reducer 170, but baffle 130A could alternatively be disposed about the intermediate exhaust segment 110B. The important part is that baffle 130A allows air to enter the air gap 150 relatively unobstructed, and that baffle 130A maintains intermediate exhaust segment 110B stably within shell segment 120A.

Baffle 130B is shown as being disposed about downstream exhaust segment 110C, and internal to the lumen of shell segment 120B. Alternatively baffle 130B could be disposed about downstream exhaust segment 110C, internal to the lumen of shell segment 120A.

Baffle 130C is preferably disposed near the top of downstream exhaust segment 110C, internal to the lumen of shell segment 120B.

An optional venturi 250 component positioned near the exhaust gas exit from downstream exhaust segment 110C can be used to assist in drawing exhaust gas up through the upstream, intermediate and downstream exhaust segments 110A, 110B, 110C.

FIG. 3 generally depicts a semi truck 300 to which has been installed an embodiment of exhaust system 100. Shown in the picture are the outsides of downstream and upstream shells 120A, 120B.

One of ordinary skill in the art would not have thought to pass exhaust gas successively through larger, smaller and then larger segments of an exhaust pipe. Among other things, passaging of the gas from the larger upstream segment to the smaller segment would be expected to add considerable back pressure to the engine, and significantly increase heat in the transition from the larger upstream segment to the smaller segment. The strain on the smaller segment is exacerbated if, as in various embodiments of the present subject matter, the smaller segment has a significant bend.

The discussion herein provides example embodiments of the inventive subject matter. Although each embodiment represents a single combination of inventive elements, the inventive subject matter is considered to include all possible combinations of the disclosed elements. Thus if one embodiment comprises elements A, B, and C, and an intermediate embodiment comprises elements B and D, then the inventive subject matter is also considered to include other remaining combinations of A, B, C, or D, even if not explicitly disclosed.

As used herein, and unless the context dictates otherwise, the term "coupled to" is intended to include both direct coupling (in which two elements that are coupled to each other contact each other) and indirect coupling (in which at least one additional element is located between the two elements). Therefore, the terms "coupled to" and "coupled with" are used synonymously.

In some embodiments, the numbers expressing quantities of ingredients, properties such as concentration, reaction conditions, and so forth, used to describe and claim certain embodiments of the invention are to be understood as being modified in some instances by the term "about." Accordingly, in some embodiments, the numerical parameters set forth in the written description and attached claims are approximations that can vary depending upon the desired properties sought to be obtained by a particular embodiment. In some embodiments, the numerical parameters should be construed in light of the number of reported significant digits and by applying ordinary rounding techniques. Notwithstanding that the numerical ranges and parameters setting forth the broad scope of some embodiments of the invention are approximations, the numerical values set forth in the specific examples are reported as precisely as practicable. The numerical values presented in some embodiments of the invention may contain certain errors necessarily resulting from the standard deviation found in their respective testing measurements.

As used in the description herein and throughout the claims that follow, the meaning of "a," "an," and "the" includes plural reference unless the context clearly dictates otherwise. Also, as used in the description herein, the meaning of "in" includes "in" and "on" unless the context clearly dictates otherwise.

The recitation of ranges of values herein is merely intended to serve as a shorthand method of referring individually to each separate value falling within the range. Unless otherwise indicated herein, each individual value is incorporated into the specification as if it were individually recited herein. All methods described herein can be performed in any suitable order unless otherwise indicated herein or otherwise clearly contradicted by context. The use of any and all examples, or exemplary language (e.g. "such as") provided with respect to certain embodiments herein is intended merely to better illuminate the invention and does not pose a limitation on the scope of the invention otherwise claimed. No language in the specification should be construed as indicating any non-claimed element essential to the practice of the invention.

Groupings of alternative elements or embodiments of the invention disclosed herein are not to be construed as limitations. Each group member can be referred to and claimed individually or in any combination with other members of the group or other elements found herein. One or more members of a group can be included in, or deleted from, a group for reasons of convenience and/or patentability. When any such inclusion or deletion occurs, the specification is herein deemed to contain the group as modified thus fulfilling the written description of all Markush groups used in the appended claims.

It should therefore be apparent to those skilled in the art that many more modifications besides those already described are possible without departing from the inventive concepts herein. The inventive subject matter, therefore, is not to be restricted except in the spirit of the appended claims. Moreover, in interpreting both the specification and the claims, all terms should be interpreted in the broadest possible manner consistent with the context. In particular, the terms "comprises" and "comprising" should be interpreted as referring to elements, components, or steps in a non-exclusive manner, indicating that the referenced elements, components, or steps may be present, or utilized, or combined with other elements, components, or steps that are not expressly referenced. Where the specification claims refers to at least one of something selected from the group consisting of A, B, C . . . and N, the text should be interpreted as requiring only one element from the group, not A plus N, or B plus N, etc.

What is claimed is:

1. An exhaust system for an internal combustion engine comprising:

an exhaust path that includes an upstream exhaust segment, an intermediate exhaust segment, and a downstream exhaust segment;

the upstream, intermediate, and downstream exhaust segments having lumens with maximal normal cross-sections, wherein a maximal inside diameter of the upstream exhaust segment and the downstream exhaust segment are each greater than a maximal inside diameter of the intermediate exhaust segment;

a reducer that gaseously couples the upstream exhaust segment to the intermediate exhaust segment;

an expander that gaseously couples the intermediate exhaust segment to the downstream exhaust segment;

a first shell segment disposed about the reducer, and spaced apart from the intermediate exhaust segment, thereby forming a first portion of a continuous air gap, wherein a first baffle positioned internal to the first shell allows ambient air to flow into the first portion of the continuous air gap through a first passageway;

a second shell segment disposed about the expander, and spaced apart from and the downstream exhaust segment, thereby forming a second portion of the continuous air gap, wherein a second baffle positioned internal to the second shell allows ambient air to flow into the second portion of the continuous air gap through a second passageway and out to the atmosphere through a third baffle;

wherein the intermediate exhaust segment has a curve that subtends an angle between 80° and 100°.

2. The exhaust system of claim 1, wherein the second shell is at least 3 meters long.

3. The exhaust system of claim 1, wherein the intermediate exhaust segment is at least 20% less than the upstream exhaust segment.

4. The exhaust system of claim 1, wherein the upstream exhaust segment has a maximal inside diameter of at least 5", the intermediate exhaust segment has a maximal inside diameter of no more than 4", and the downstream segment has a maximal inside diameter of at least 4.75".

5. The exhaust system of claim 1, wherein at least one of the upstream, intermediate and downstream exhaust segments comprise a stainless steel.

6. The exhaust system of claim 1, wherein each of the first and second shells has a chrome coating.

7. The exhaust system of claim 1, wherein a downstream end of the first shell is positioned to abut an upstream end of the second shell.

* * * * *